US005195450A

United States Patent [19]

Marion

[11] Patent Number: 5,195,450

[45] Date of Patent: Mar. 23, 1993

[54] ADVANCED OVERFIRE AIR SYSTEM FOR $NO_x$ CONTROL

[75] Inventor: John L. Marion, Simsbury, Conn.

[73] Assignee: Combustion Engineering, Inc., Windsor, Conn.

[21] Appl. No.: 808,244

[22] Filed: Dec. 16, 1991

Related U.S. Application Data

[62] Division of Ser. No. 607,177, Oct. 31, 1990, abandoned.

[51] Int. Cl.[5] ..... F23K 1/00; F23D 1/00

[52] U.S. Cl. ..... 110/347; 110/263; 110/264; 122/4 D

[58] Field of Search ..... 110/347, 263, 264; 122/4 D

[56] References Cited

U.S. PATENT DOCUMENTS

| | | | |
|---|---|---|---|
| 4,426,939 | 1/1984 | Winship | 110/347 |
| 4,434,747 | 3/1984 | Chadshay | 110/263 |
| 4,501,204 | 2/1985 | McCartney | 110/264 |
| 4,651,653 | 3/1987 | Anderson et al. | 122/4 D |
| 4,669,398 | 6/1987 | Takahashi et al. | 110/347 |
| 4,715,301 | 12/1987 | Bianca et al. | 110/347 |
| 4,722,287 | 2/1988 | Anderson et al. | 110/264 |
| 4,878,442 | 11/1989 | Yeh et al. | 110/345 |
| 4,962,711 | 10/1990 | Yamauchi et al. | 110/347 |

*Primary Examiner*—Henry C. Yuen
*Attorney, Agent, or Firm*—Arthur E. Fournier, Jr.

[57] ABSTRACT

An advanced overfire air system for $NO_x$ control designed for use in a firing system of the type that is particularly suited for use in fossil fuel-fired furnaces and a method of operating such a furnace which embodies an advanced overfire air system. The advanced overfire air system for $NO_x$ control includes multielevations of overfire air compartments consisting of a plurality of close coupled overfire air compartments and a plurality of separated overfire air compartments. The close coupled overfire air compartments are supported at a first elevation in the furnace and the separated overfire air compartments are supported at a second elevation in the furnace so as to be spaced from but aligned with the close coupled overfire air compartments. Overfire air is supplied to both the close coupled overfire air compartments and the separated overfire air compartments such that there is a predetermined most favorable distribution of overfire air therebetween, such that the overfire air exiting from the separated overfire air compartments establishes a horizontal "spray" or "fan" distribution of overfire air over the plan area of the furnace, and such that the overfire air exits from the separated overfire air compartments at velocities significantly higher than the velocities employed heretofore.

4 Claims, 6 Drawing Sheets

ADVANCED OVERFIRE AIR SYSTEM FOR $NO_x$ CONTROL

This is a division, of application Ser. No. 07/607,177, filed Oct. 31, 1990, now abandoned.

CROSS-REFERENCE TO RELATED APPLICATION

This application is hereby cross-referenced to the following patent application which was commonly filed herewith and which is commonly assigned: U.S. patent application Ser. No. 07/606,682, filed Oct. 31, 1990, entitled "A CLUSTERED CONCENTRIC TANGENTIAL FIRING SYSTEM" filed in the names of Todd D. Hellewell, John Grusha and Michael S. McCartney, which issued on Jun. 4, 1991 as U.S. Pat. No. 5,020,454.

BACKGROUND OF THE INVENTION

This invention relates to tangentially fired, fossil fuel furnaces, and more specifically, to overfire air systems for reducing the $NO_x$ emissions from tangentially fired, pulverized coal furnaces.

Pulverized coal has been successfully burned in suspension in furnaces by tangential firing methods for a long time. The tangential firing technique involves introducing the fuel and air into a furnace from the four corners thereof so that the fuel and air are directed tangent to an imaginary circle in the center of the furnace. This type of firing has many advantages, among them being good mixing of the fuel and the air, stable flame conditions, and long residence time of the combustion gases in the furnaces.

Recently though, more and more emphasis has been placed on the minimization as much as possible of air pollution. To this end, most observers in the United States expect the U.S. Congress to enact comprehensive air emission reduction legislation by no later than the end of 1990. The major significance that such legislation will have is that it will be the first to mandate the retrofitting of $NO_x$ and $SO_x$ controls on existing fossil fuel fired units. Heretofore, prior laws have only dealt with the new construction of units.

With further reference in particular to the matter of $NO_x$ control, it is known that oxides of nitrogen are created during fossil fuel combustion by two separate mechanisms which have been identified to be thermal $NO_x$ and fuel $NO_x$. Thermal $NO_x$ results from the thermal fixation of molecular nitrogen and oxygen in the combustion air. The rate of formation of thermal $NO_x$ is extremely sensitive to local flame temperature and somewhat less so to local concentration of oxygen. Virtually all thermal $NO_x$ is formed at the region of the flame which is at the highest temperature. The thermal $NO_x$ concentration is subsequently "frozen" at the level prevailing in the high temperature region by the thermal quenching of the combustion gases. The flue gas thermal $NO_x$ concentrations are, therefore, between the equilibrium level characteristic of the peak flame temperature and the equilibrium level at the flue gas temperature.

On the other hand, fuel $NO_x$ derives from the oxidation of organically bound nitrogen in certain fossil fuels such as coal and heavy oil. The formation rate of fuel $NO_x$ is strongly affected by the rate of mixing of the fuel and air stream in general, and by the local oxygen concentration in particular. However, the flue gas $NO_x$ concentration due to fuel nitrogen is typically only a fraction, e.g., 20 to 60 percent, of the level which would result from complete oxidation of all nitrogen in the fuel. From the preceding it should thus now be readily apparent that overall $NO_x$ formation is a function both of local oxygen levels and of peak flame temperatures.

Continuing, some changes have been proposed to be made in the standard tangential firing technique. These changes have been proposed primarily in the interest of achieving an even better reduction of emissions through the use thereof. One such change resulted in the arrangement that was the subject matter of U.S. patent application, Ser. No. 786,437, now abandoned, entitled "A Control System And Method For Operating A Tangentially Fired Pulverized Coal Furnace", which was filed on Oct. 11, 1985 and which was assigned to the same assignee as the present patent application. In accordance with the teachings of the aforesaid U.S. patent application, it was proposed to introduce pulverized coal and air tangentially into the furnace from a number of lower burner levels in one direction, and to introduce coal and air tangentially into the furnace from a number of upper burner levels in the opposite direction. As a consequence of utilizing this type of arrangement, it was alleged that better mixing of the fuel and air was accomplished, thus permitting the use of less excess air than with a normal tangentially fired furnace, which, as is well-known to those skilled in the art, is generally fired with 20–30% excess air. The reduction in excess air helps minimize the formation of $NO_x$ which, as noted previously herein, is a major air pollutant of coal-fired furnaces. It also results in increased efficiency of the unit. Although the firing technique to which the aforesaid U.S. patent application was directed reduces $NO_x$, there were some disadvantages associated therewith. Namely, since the reverse rotation of the gases in the furnace cancel each other out, the gases flow in a more or less straight line through the upper portion of the furnace, thereby increasing the possibility of unburned carbon particles leaving the furnace due to reduced upper furnace turbulence and mixing. In addition, slag and unburned carbon deposits on the furnace walls can occur. These wall deposits reduce the efficiency of heat transfer to the water-cooled tubes lining the walls, increases the need for soot blowing, and reduces the life span of the tubes.

Another such change resulted in the arrangement that forms the subject matter of U.S. Pat. No. 4,715,301 entitled "Low Excess Air Tangential Firing System", which issued on Dec. 29, 1987 and which is assigned to the same assignee as the present patent application. In accordance with the teachings of U.S. Pat. No. 4,715,301, a furnace is provided in which pulverized coal is burned in suspension with good mixing of the coal and air, as in the case of the now abandoned U.S. patent application, which has been the subject of discussion hereinabove. Furthermore, all of the advantages previously associated with tangentially fired furnaces are obtained, by having a swirling, rotating fireball in the furnace. The walls are protected by a blanket of air, reducing slagging thereof. This is accomplished by introducing coal and primary air into the furnace tangentially at a first level, introducing auxiliary air in an amount at least twice that of the primary air into the furnace tangentially at a second level directly above the first level, but in a direction opposite to that of the primary air, with there being a plurality of such first and second levels, one above the other. As a result of the greater mass and velocity of the auxiliary air, the ultimate swirl within the furnace will be in the direction of the auxiliary air introduction. Because of this, the fuel, which is introduced in a direction counter to the swirl of the furnace, is forced after entering the unit, to change direction to that of the overall furnace gases. Tremendous turbulent mixing between the fuel and air is thus created in this process. This increased mixing reduces the need for high levels of excess air within the furnace. This increase mixing also results in enhanced carbon conversion which improves the unit's overall heat release rate while at the same time reducing upper furnace slagging and fouling. The auxiliary air is directed at a circle of larger diameter than that of the fuel, thus forming a layer of air adjacent the walls. In addition, overfire air, consisting essentially of all of the excess air supplied to the furnace, is introduced into the furnace at a level considerably above all of the primary and auxiliary air introduction levels, with the overfire air being directed tangentially to an imaginary circle, and in a direction opposite to that of the auxiliary air.

Yet another such change resulted in the arrangement for firing pulverized coal as a fuel with low $NO_x$ emissions that forms the subject matter of U.S. Pat. No. 4,669,398, entitled "Pulverized Fuel Firing Apparatus"Z, and which issued on Jun. 2, 1987. In accordance with the teachings of U.S. Pat. No. 4,669,398, an apparatus is provided which is characterized by a first pulverized fuel injection compartment in which the combined amount of primary air and secondary air to be consumed is less than the theoretical amount of air required for the combustion of the pulverized fuel to be fed as mixed with the primary air to a furnace, by a second pulverized fuel injection compartment in which the combined primary and secondary air amount is substantially equal to, or, preferably, somewhat less than, the theoretical air for the fuel to be fed as mixed with the primary air, and by a supplementary air compartment for injecting supplementary air into the furnace, the three compartments being arranged close to one another. The gaseous mixtures of primary air and pulverized fuel injected by the first and second pulverized fuel injection compartments of the apparatus are mixed in such proportions as to reduce the $NO_x$ production. Moreover, the primary air-pulverized fuel mixture from the second pulverized fuel injection compartment, which alone can hardly be ignited stably, is allowed to coexist with the flame of the readily ignitible mixture from the first pulverized fuel injection compartment to ensure adequate ignition and combustion. An apparatus is thus allegedly provided for firing pulverized fuel with stable ignition and low $NO_x$ production.

Secondly, the apparatus in accordance with the teachings of U.S. Pat. No. 4,669,398 is characterized in that additional compartments for issuing an inert fluid are disposed, one for each, in spaces provided between the three compartments. The gaseous mixtures of primary air and pulverized fuel are thus kept from interfering with each other by a curtain of the inert fluid from one of the inert fluid injection compartments, and the production of $NO_x$ from the gaseous mixtures that are discharged from the first and second pulverized fuel injection compartments allegedly can be minimized. Also, the primary air-pulverized fuel mixture from the first pulverized fuel injection compartment and the supplementary air from the supplementary air compartment are prevented from interfering with each other by another curtain of the inert fluid from another compartment. This allegedly permits the primary air-pulverized fuel mixture to burn without any change in the mixing ratio, thus avoiding any increase in the $NO_x$ production.

Yet still another change resulted in the arrangement for firing pulverized coal as a fuel while at the same time effecting a reduction in $NO_x$ and SOx emission that forms the subject matter of U.S. Pat. No. 4,426,939, entitled "Method Of Reducing $NO_x$ and $SO_x$ Emission", which issued on Jan. 24, 1984 and which is assigned to the same assignee as the present patent application. In accordance with the teachings of U.S. Pat. No. 4,426,939, a furnace is fired with pulverized coal in a manner that reduces the peak temperature in the furnace while still maintaining good flame stability and complete combustion of the fuel. The manner in which this is accomplished is as follows. Pulverized coal is conveyed in an air stream towards the furnace. In the course of being so conveyed, the stream is separated into two portions, with one portion being a fuel rich portion and the other portion being a fuel lean portion. The fuel rich portion is introduced into the furnace in a first zone. Air is also introduced into the first zone in a quantity insufficient to support complete combustion of all of the fuel in the fuel rich portion. The fuel lean portion, on the other hand, is introduced into the furnace in a second zone. Also, air is introduced into the second zone in a quantity such that there is excess air over that required for combustion of all of the fuel within the furnace. Lastly, lime is introduced into the furnace simultaneously with the fuel so as to minimize the peak temperature within the furnace and so as to also minimize the formation of $NO_x$ and $SO_x$ in the combustion gases.

Although firing systems constructed in accordance with the teachings of the now abandoned U.S. patent application and the three issued U.S. patents to which reference has been made hereinbefore have been demonstrated to be operative for the purpose for which they have been designed, there has nevertheless been evidenced in the prior art a need for such firing systems to be improved. More specifically, a need has been evidenced in the prior art for a new and improved firing system that would be advantageously characterized by the fact that an advanced overfire air system is incorporated therein. To this end, the basic concept of overfire air has been proven to be the most cost effective method for controlling $NO_x$ in tangentially fired, fossil fuel furnaces. Overfire air is introduced into the furnace tangentially through additional air compartments, termed overfire air ports, that are designed as vertical extensions of the corner windboxes with which the tangentially fired, fossil fuel furnace is equipped.

The theory of $NO_x$ emissions reduction by overfire air is as follows. Operation with overfire air inhibits the rate of $NO_x$ formation by both atmospheric nitrogen fixation (thermal $NO_x$) and fuel nitrogen oxidation (fuel $NO_x$). The use of overfire air reduces the total oxygen available in the primary flame zone. As a result of this reduced oxygen zone, fuel nitrogen undergoes a recombination reaction to form molecular nitrogen, $N_2$, rather than nitrogen oxide, simply due to insufficient oxygen in this zone and the intense competition with carbon species for the available oxygen. Consequently, the formation of $NO_x$ through fuel nitrogen conversion is greatly reduced. Similarly, overfire air operation results in reduction of thermal $NO_x$ formation through the temperature dependent Zeldovich mechanism. Heat release during the initial stages of combustion in the primary flame zone is somewhat reduced and delayed due to the reduced oxygen environment, with combustion ideally completed in the vicinity of the overfire air injection ports. The stretching of the heat release over a greater furnace volume results in lower peak combustion temperatures, thereby reducing thermal $NO_x$ formation.

Typical application of overfire air is through one or two closely grouped ports at a single fixed elevation at the top of the windbox, referred to as close-coupled overfire air, or at a higher elevation, referred to as separated overfire air. Experimental testing has shown a significant reduction in $NO_x$ with fossil fuel firing when, for a fixed total quantity of overfire air, the overfire air is introduced partly through close-couple overfire air ports and partly through separated overfire air ports. Moreover, experimental testing has shown that there exists a most favorable distribution of overfire air between the close coupled overfire air ports and the separated overfire air ports. In the case of bituminous coal, for example, this most favorable distribution has $\frac{1}{3}$ of the overfire air flowing through the close coupled overfire air ports and $\frac{2}{3}$ of the overfire air flowing through the separated overfire air ports.

In addition to the above, the manner in which overfire air is introduced into a furnace such that the air mixes with furnace gases in a controlled and thorough manner is also critical to maximizing overfire air effectiveness. Test data has shown that improvements in $NO_x$ emissions are attainable when the overfire air is injected from each furnace corner through two, three or more compartments with each compartment introducing a portion of the total overfire air flow at different firing angles such as to achieve a horizontal "spray" or "fan" distribution of air over the furnace plan area as compared to when other injection patterns are utilized for purposes of injecting the overfire air into the furnace. In addition, it has been found that through the use of such an injection pattern for the overfire air, furnace outlet conditions are also improved inasmuch as a more uniform flame pattern is created at the vertical outlet plane of the furnace. All tangentially fired, fossil fuel furnaces have a nonuniform flow pattern in the convective pass due to the tangential lower furnace flow pattern. This nonuniform flow pattern results in more flow on one side than the other and creates a side-to-side imbalance in steam temperature. The introduction of overfire air into the furnace by means of the injection pattern that has been described above wherein through the use thereof a horizontal "spray" or "fan" distribution of overfire air over the furnace plan area is had reduces this imbalance.

Finally, improved overfire air mixing with the furnace gases can be had by introducing the overfire air at high momentum. To achieve high overfire air momentum, the overfire air is introduced at velocities significantly above those typically employed in prior art firing systems, e.g., 200 to 300 ft./sec. versus 100 to 150 ft./sec. A boost fan may be needed to attain these higher overfire air velocities.

To thus summarize, a need has been evidenced in the prior art for such a new and improved firing system incorporating an advanced overfire air system that would be particularly suited for use in connection with tangentially fired, fossil fuel furnaces and that when so employed therein would render it possible to accomplish through the use thereof reductions in the level of $NO_x$ emissions to levels that are at least equivalent to, if not better than, that which is currently being contemplated as the standard for the United States in legislation which is being proposed. Moreover, such results would be achievable with such a new and improved firing system incorporating an advanced overfire air system without the necessity of requiring for the operation thereof any additions, catalysts or added premium fuel costs. Furthermore, such results would be obtainable with such a new and improved firing system incorporating an advanced overfire air system which is totally compatible with other emission reduction-type systems such as limestone injection systems, reburn systems and selective catalytic reduction (SCR) systems that one might seek to employ in order to accomplish additional emission reduction. Last but not least, such results would be attainable with such a new and improved firing system incorporating an advanced overfire air system which is equally suitable for use either in new applications or in retrofit applications.

It is, therefore, an object of the present invention to provide a new and improved advanced overfire air system for $NO_x$ control which is designed for use in a firing system of the type that is employed in fossil fuel-fired furnaces.

It is a further object of the present invention to provide such an advanced overfire air system for $NO_x$ control that is designed for use in a firing system of the type that is employed in tangentially fired, fossil fuel furnaces.

It is another object of the present invention to provide such an advanced overfire air system for $NO_x$ control that is designed for use in a firing system of the type employed in tangentially fired, fossil fuel furnaces such that through the use thereof $NO_x$ emissions are capable of being reduced to levels that are at least equivalent to, if not better than, that which is currently being contemplated as the standard for the United States in the legislation being proposed.

Another object of the present invention is to provide such an advanced overfire air system for $NO_x$ control that is designed for use in a firing system of the type employed in tangentially fired, fossil fuel furnaces characterized in that the advanced overfire air system involves the use of multi-elevations of overfire air compartments consisting of close coupled overfire air compartments and separated overfire air compartments.

A still another object of the present invention is to provide such a multi-elevation advanced overfire air system for $NO_x$ control that is designed for use in a firing system of the type employed in tangentially fired, fossil fuel furnaces and which is characterized in that there is a predetermined most favorable distribution of overfire air between the close coupled overfire air compartments and the separated overfire air compartments.

A further object of the present invention is to provide such an advanced overfire air system for $NO_x$ control that is designed for use in a firing system of the type employed in tangentially fired, fossil fuel furnaces and which is characterized in that the advanced overfire air system involves the use of a multi-angle injection pattern.

A still further object of the present invention is to provide such an advanced overfire air system for $NO_x$ control that is designed for use in a firing system of the type employed in tangentially fired, fossil fuel furnaces and which is characterized in that in accordance with the multi-angle injection pattern thereof a portion of the total overfire air flow is introduced at different firing angles such as to achieve a horizontal "spray" or "fan"

distribution of overfire air over the plan area of the furnace.

Yet an object of the present invention is to provide such an advanced overfire air system for $NO_x$ control that is designed for use in a firing system of the type employed in tangentially fired, fossil fuel furnaces and which is characterized in that the advanced overfire air system involves the injection of overfire air into the furnace at velocities significantly higher than those utilized heretofore in prior art firing systems.

Yet a further object of the present invention is to provide such an advanced overfire air system for $NO_x$ control that is designed for use in a firing system of the type employed in tangentially fired, fossil fuel furnaces such that through the use thereof no additions, catalysts or added premium fuel costs are needed for the operation thereof.

Yet another object of the present invention is to provide such an advanced overfire air system for $NO_x$ control that is designed for use in a firing system of the type employed in tangentially fired, fossil fuel furnaces and which is characterized in that the advanced overfire air system is totally compatible with other emission reduction-type systems such as limestone injection systems, reburn systems and selective catalytic reduction (SCR) systems that one might seek to employ in order to accomplish additional emission reduction.

Yet still another object of the present invention is to provide such an advanced overfire air system for $NO_x$ control that is designed for use in a firing system of the type employed in tangentially fired, fossil fuel furnaces and which is characterized in that the advanced overfire air system is equally well suited for use either in new applications or in retrofit applications.

SUMMARY OF THE INVENTION

In accordance with one aspect of the present invention there is provided an advanced overfire air system for $NO_x$ control which is designed for use in a firing system of the type that is particularly suited for employment in fossil fuel-fired furnaces embodying a burner region. The subject advanced overfire air system includes multi-elevations of overfire air compartments. These multi-elevations of overfire air compartments consist of a plurality of close coupled overfire air compartments and a plurality of separated overfire air compartments. The plurality of close coupled overfire air compartments are suitably supported at a first elevation within the burner region of the furnace. A close coupled overfire air nozzle is supported in mounted relation within each of the plurality of close coupled overfire air compartments. The plurality of separated overfire air compartments are suitably supported at a second elevation within the burner region of the furnace so as to be spaced from but aligned with the plurality of close coupled overfire air compartments. A plurality of separated overfire air nozzles are supported in mounted relation within the plurality of separated overfire air compartments such that the plurality of separated overfire air nozzles extend at different angles relative to each other whereby the overfire air exiting therefrom establishes a horizontal "spray" or "fan" distribution of overfire air over the plan area of the burner region of the furnace. An overfire air supply means is operatively connected to both the close coupled overfire air nozzles and to the separated overfire air nozzles for supplying overfire air thereto in accordance with a predetermined most favorable distribution of overfire air therebetween and for supplying overfire air through the separated overfire air nozzles into the burner region of the furnace at velocities significantly higher than the velocities employed heretodate in prior art firing systems to inject overfire air into a furnace.

In accordance with another aspect of the present invention there is provided a method of operating an advanced overfire air system for $NO_x$ control which is designed for use in a firing system of the type that is particularly suited for employment in fossil fuel-fired furnaces embodying a burner region. The subject method of operating an advanced overfire air system for $NO_x$ control includes the steps of injecting close coupled overfire air into the burner region of the furnace at a first elevation thereof and of injecting separated overfire air into the burner region of the furnace at a second elevation thereof in accordance with a predetermined most favorable distribution of overfire air between the first elevation and the second elevation, and such that the overfire air being injected into the burner region of the furnace at the second elevation thereof establishes a horizontal "spray" or "fan" distribution of overfire air over the plan area of the burner region of the furnace and such that the overfire air being injected into the burner region of the furnace at the second elevation thereof is injected into the burner region of the furnace at velocities significantly higher than the velocities employed heretodate in prior art firing systems to inject overfire air into a furnace.

DESCRIPTION OF THE PREFERRED EMBODIMENT

Figure 1:
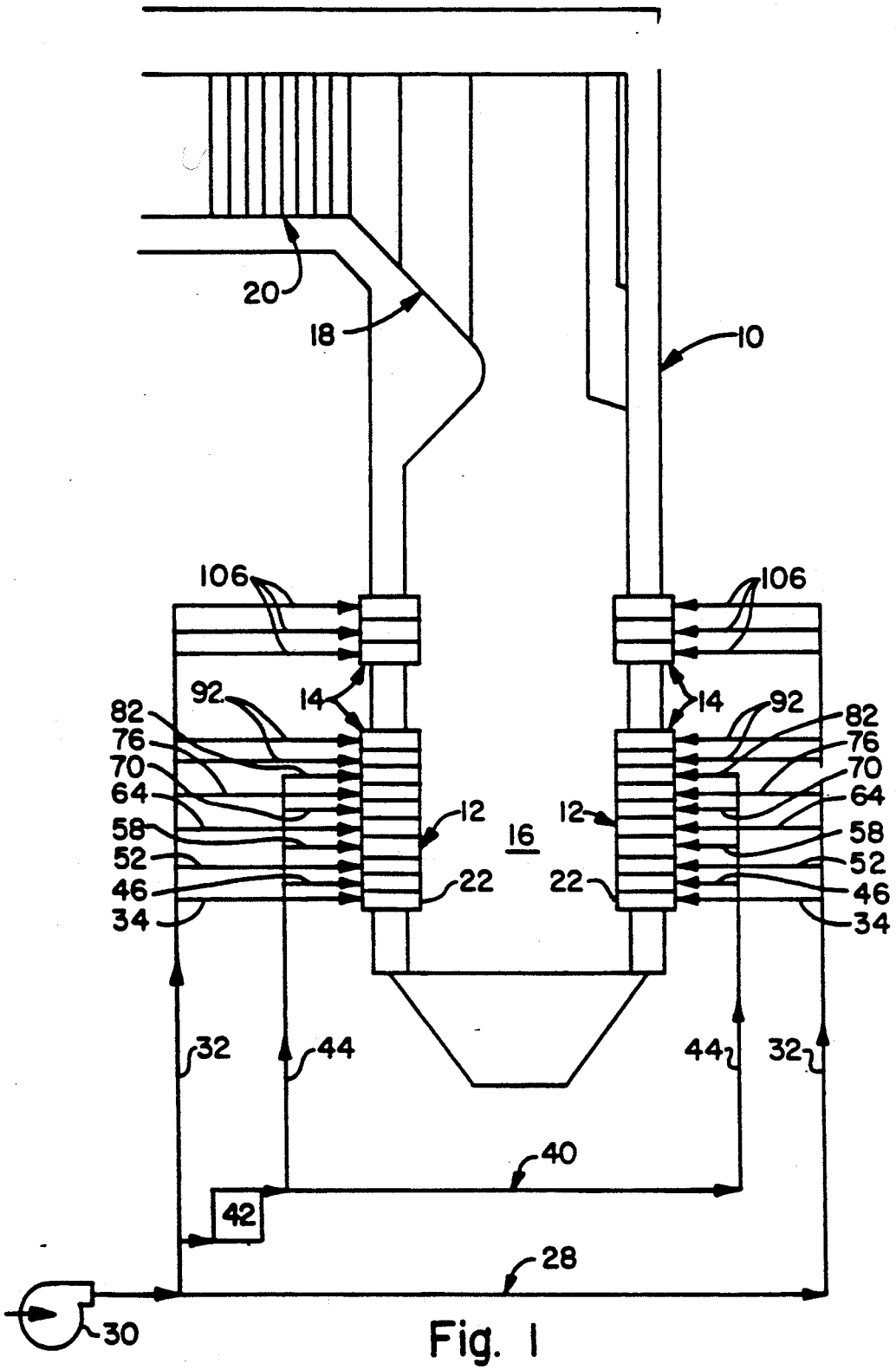
FIG. 1 is a diagrammatic representation in the nature of a vertical sectional view of a fossil fuel-fired furnace embodying an advanced overfire air system for $NO_x$ control constructed in accordance with the present invention.

Referring now to the drawing, and more particularly to FIG. 1 thereof, there is depicted therein a fossil fuel-fired furnace, generally designated by the reference numeral 10. Inasmuch as the nature of the construction and the mode of operation of fossil fuel-fired furnaces per se are well-known to those skilled in the art, it is not deemed necessary, therefore, to set forth herein a detailed description of the fossil fuel-fired furnace 10 illustrated in FIG. 1. Rather, for purposes of obtaining an understanding of a fossil fuel-fired furnace 10, which is capable of having cooperatively associated therewith a firing system, generally designated by the reference numeral 12 in FIG. 1 of the drawing, embodying an advanced overfire air system, generally designated by the reference numeral 14 in FIG. 1 of the drawing, constructed in accordance with the present invention such that in accordance with the present invention the advanced overfire air system 14 is capable of being installed in the furnace 10 as part of the firing system 12 and when so installed therein is operative for reducing the $NO_x$ emissions from the fossil fuel-fired furnace 10, it is deemed to be sufficient that there be presented herein merely a description of the nature of the components of the fossil fuel-fired furnace 10 with which the aforesaid firing system 12 and the aforesaid advanced overfire air system 14 cooperate. For a more detailed description of the nature of the construction and the mode of operation of the components of the fossil fuel-fired furnace 10, which are not described herein, one may have reference to the prior art, e.g., U.S. Pat. No. 4,719,587, which issued on Jan. 12, 1988 to F. J. Berte and which is assigned to the same assignee as the present application.

Referring further to FIG. 1 of the drawing, the fossil fuel-fired furnace 10 as illustrated therein includes a burner region, generally designated by the reference numeral 16. As will be described more fully hereinafter in connection with the description of the nature of the construction and the mode of operation of the firing system 12 and of the advanced overfire air system 14, it is within the burner region 16 of the fossil fuel-fired furnace 10 that in a manner well-known to those skilled in this art combustion of the fossil fuel and air is initiated. The hot gases that are produced from combustion of the fossil fuel and air rise upwardly in the fossil fuel-fired furnace 10. During the upwardly movement thereof in the fossil fuel-fired furnace 10, the hot gases in a manner well-known to those skilled in this art give up heat to the fluid flowing through the tubes (not shown in the interest of maintaining clarity of illustration in the drawing) that in conventional fashion line all four of the walls of the fossil fuel-fired furnace 10. Then, the hot gases exit the fossil fuel-fired furnace 10 through the horizontal pass, generally designated by the reference numeral 18, of the fossil fuel-fired furnace 10, which in turn leads to the rear gas pass, generally designated by the reference numeral 20, of the fossil fuel-fired furnace 10. Both the horizontal pass 18 and the rear gas pass 20 commonly contain other heat exchanger surface (not shown) for generating and super heating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine (not shown), such that electricity is thus produced from the generator (not shown).

Figure 2:
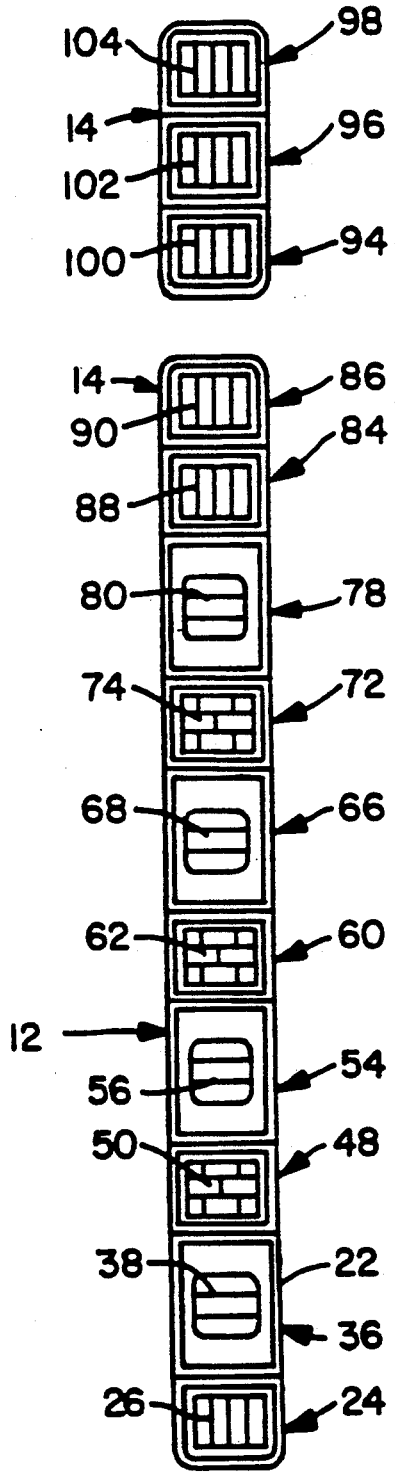
FIG. 2 is a diagrammatic representation in the nature of a vertical sectional view of a firing system of the type employed in tangentially fired, fossil-fuel furnaces illustrating the embodiment therein of an advanced overfire air system for $NO_x$ control constructed in accordance with the present invention.

With the preceding by way of background, reference will now be had particularly to FIGS. 1 and 2 of the drawing for purposes of describing the firing system 12 and the advanced overfire air system 14 which in accordance with the present invention is designed for use as part of a firing system, such as the firing system 12, and with the firing system, such as the firing system 12, in turn being designed to be cooperatively associated with a furnace constructed in the manner of the fossil fuel-fired furnace 10 that is depicted in FIG. 1 of the drawing. More specifically, the advanced overfire air system 14 is designed to be utilized in a firing system, such as the firing system 12, so that when the firing system 12 in turn is utilized in a furnace, such as the fossil fuel-fired furnace 10 of FIG. 2 of the drawing, the advanced overfire air system 14 is operative to reduce the $NO_x$ emissions from the fossil fuel-fired furnace 10.

Considering first the firing system 12, as best understood with reference to FIGS. 1 and 2 of the drawing the firing system 12 includes a housing preferably in the form of a windbox denoted by the reference numeral 22 in FIGS. 1 and 2 of the drawing. The windbox 22 in a manner well-known to those skilled in this art is supported by conventional support means (not shown) in the burner region 16 of the fossil fuel-fired furnace 10 such that the longitudinal axis of the windbox 22 extends substantially in parallel relation to the longitudinal axis of the fossil fuel-fired furnace 10.

Continuing with the description of the firing system 12, in accordance with the illustration thereof in FIGS. 1 and 2 of the drawing a first air compartment, denoted generally by the reference numeral 24 in FIG. 2 of the drawing, is provided at the lower end of the windbox 22. An air nozzle, denoted by the reference numeral 26, is supported in mounted relation, through the use of any conventional form of mounting means (not shown) suitable for use for such a purpose, within the air compartment 24. An air supply means, which is illustrated schematically in FIG. 1 of the drawing wherein the air supply means is denoted generally by the reference numeral 28, is operatively connected in a manner to be more fully described hereinafter to the air nozzle 26 whereby the air supply means 28 supplies air to the air nozzle 26 and therethrough into the burner region 16 of the fossil fuel-fired furnace 10. To this end, the air supply means 28 includes a fan seen at 30 in FIG. 1 of the drawing, and the air ducts denoted by the reference numeral 32 which are connected in fluid flow relation to the fan 30 on the one hand and on the other hand, as seen schematically at 34 in FIG. 1 of the drawing, to the air nozzle 26 through separate valves and controls (not shown).

With further reference to the windbox 22, in accordance with the nature of the construction of the illustrated embodiment of the firing system 12 a first fuel compartment, denoted generally by the reference numeral 36 in FIG. 2 of the drawing, is provided in the windbox 22 within the lower portion thereof such as to be located substantially in juxtaposed relation to the air compartment 24. A first fuel nozzle, denoted by the reference numeral 38 in FIG. 2 of the drawing, is supported in mounted relation, through the use of any conventional form of mounting means (not shown) suitable for use for such a purpose, within the fuel compartment 36. A fuel supply means, which is illustrated schematically in FIG. 1 of the drawing wherein the fuel supply means is denoted generally by the reference numeral 40, is operatively connected in a manner to be more fully described hereinafter to the fuel nozzle 38 whereby the fuel supply means 40 supplies fuel to the fuel nozzle 38 and therethrough into the burner region 16 of the fossil fuel-fired furnace 10. Namely, the fuel supply means 40 includes a pulverizer, seen at 42 in FIG. 1 of the drawing, wherein the fossil fuel that is to be burned in the fossil fuel-fired furnace 10 undergoes pulverization in a manner well-known to those skilled in this art, and the fuel ducts, denoted by the reference numeral 44, which are connected in fluid flow relation to the pulverizer 42 on the one hand and on the other hand, as seen schematically at 46 in FIG. 1 of the drawing, to the fuel nozzle 38 through separate valves and controls (not shown). As can be seen with reference to FIG. 1 of the drawing, the pulverizer 42 is operatively connected to the fan 30 such that air is also supplied from the fan 30 to the pulverizer 42 whereby the fuel supplied from the pulverizer 42 to the fuel nozzle 38 is transported through the fuel ducts 44 in an air stream in a manner which is well-known to those skilled in this art.

In addition to the air compartment 24 and the fuel compartment 36, which have been described hereinabove, the windbox 22 is also provided with a second air compartment, denoted generally by the reference numeral 48 in FIG. 2 of the drawing. The air compartment 48, as best understood with reference to FIG. 2 of the drawing, is provided in the windbox 22 such as to be located substantially in juxtaposed relation to the fuel compartment 36. An air nozzle, denoted by the reference numeral 50 in FIG. 2 of the drawing, is supported in mounted relation, through the use of any conventional form of mounting means (not shown) suitable for use for such a purpose, within the air compartment 48. The air nozzle 50 is operatively connected to the air supply means 28, the latter having been described herein previously, through the air ducts 32, which as best understood with reference to FIG. 1 of the drawing are connected in fluid flow relation to the fan 30 on the one hand and on the other hand, as seen schematically at 52 in FIG. 1 of the drawing, to the air nozzle 50 through separate valves and controls (not shown) whereby the air supply means 28 supplies air to the air nozzle 50 and therethrough into the burner region 16 of the fossil fuel-fired furnace 10 in the same manner as that which has been described herein previously in connection with the discussion hereinbefore of the air nozzle 26.

Continuing with the description of the firing system 12, in accord with the illustrated embodiment thereof a second fuel compartment, denoted generally by the reference numeral 54 in FIG. 2 of the drawing, is provided in the windbox 22 such as to be located substantially in juxtaposed relation to the air compartment 48. A second fuel nozzle, denoted generally by the reference numeral 56 in FIG. 2 of the drawing, is supported in mounted relation, through the use of any conventional form of mounting means (not shown) suitable for use for such a purpose, within the fuel compartment 54. The fuel nozzle 56 is operatively connected to the fuel supply means 40, the latter having been described previously herein, through the fuel ducts 44, which as best understood with reference to FIG. 1 of the drawing, are connected in fluid flow relation on the one hand to the pulverizer 42 wherein the fossil fuel that is to be burned in the fossil fuel-fired furnace 10 undergoes pulverization in a manner well-known to those skilled in the art, and on the other hand, as seen schematically at 58 in FIG. 1 of the drawing, to the fuel nozzle 56 through separate valves and controls (not shown) whereby the fuel supply means 40 supplies fuel to the fuel nozzle 56 and therethrough into the burner region 16 of the fossil fuel-fired furnace 10 in the same manner as that which has been described herein previously in connection with the discussion hereinbefore of the fuel nozzle 38. Mention is once again made here of the fact that as can be seen with reference to FIG. 1 of the drawing, the pulverizer 42 is operatively connected to the fan 30 such that air is also supplied from the fan 30 to the pulverizer 42 whereby the fuel supplied from the pulverizer 42 to the fuel compartment 54 is transported through the fuel ducts 44 in an air stream in a manner which is well-known to those skilled in the art.

With further reference to the windbox 22, in accord with the illustrated embodiment thereof, there is provided therein a third air compartment, denoted generally by the reference numeral 60 in FIG. 2 of the drawing. The air compartment 60, as best understood with reference to FIG. 2 of the drawing, is provided in the windbox 22 such as to be located substantially in juxtaposed relation to the fuel compartment 54. An air nozzle, denoted by the reference numeral 62 in FIG. 2 of the drawing, is supported in mounted relation, through the use of any conventional form of mounting means (not shown) suitable for use for such a purpose, within the air compartment 60. The air nozzle 62 is operatively connected to the air supply means 28, the latter having been described herein previously, through the air ducts 32, which as best understood with reference to FIG. 1 of the drawing are connected in fluid flow relation to the fan 30 on the one hand and on the other hand, as seen schematically at 64 in FIG. 1 of the drawing, to the air nozzle 62 through separate valves and controls (not shown) whereby the air supply means 28 supplies air to the air nozzle 62 and therethrough into the burner region 16 of the fossil fuel-fired furnace 10 in the same manner as that which has been described herein previously in connection with the discussion hereinbefore of the air nozzles 26 and 50.

In addition to the foregoing, the firing system 12, in accordance with the embodiment thereof illustrated in FIGS. 1 and 2 of the drawing, further includes a third fuel compartment, denoted generally by the reference numeral 66 in FIG. 2 of the drawing. The fuel compartment 66 is provided in the windbox 22 such as to be located substantially in juxtaposed relation to the air compartment 60. A third fuel nozzle, denoted by the reference numeral 68 in FIG. 2 of the drawing, is supported in mounted relation, through the use of any conventional form of mounting means (not shown) suitable for use for such a purpose, within the fuel compartment 66. The fuel nozzle 68 is operatively connected to the fuel supply means 40, the latter having been described previously herein, through the fuel ducts 44, which as best understood with reference to FIG. 1 of the drawing are connected in fluid flow relation on the one hand to the pulverizer 42 wherein the fossil fuel that is to be burned in the fossil fuel-fired furnace 10 undergoes pulverization in a manner well-known to those skilled in the art, and on the other hand as seen schematically at 70 in FIG. 1 of the drawing to the fuel nozzle 68 through separate valves and controls (not shown) whereby the fuel supply means 40 supplies fuel to the fuel nozzle 68 and therethrough into the burner region 16 of the fossil fuel-fired furnace 10 in the same manner as that which has been described herein previously in connection with the discussion hereinbefore of the fuel nozzles 38 and 56. As mentioned previously herein, the pulverizer 42 as can be seen with reference to FIG. 1 of the drawing is operatively connected to the fan 30 such that air is also supplied from the fan 30 to the pulverizer 42 whereby the fuel supplied from the pulverizer 42 to the fuel compartment 66 is transported through the fuel ducts 44 in an air stream in a manner well-known to those skilled in the art.

Continuing with the description of the firing system 12, in accord with the embodiment thereof illustrated in FIGS. 1 and 2 of the drawing there is provided in the windbox 22 a fourth air compartment, denoted generally by the reference numeral 72 in FIG. 2 of the drawing. The fourth air compartment 72 is provided in the windbox 22 such as to be located substantially in juxtaposed relation to the fuel compartment 66. A fourth air nozzle, denoted by the reference numeral 74 in FIG. 2 of the drawing, is supported in mounted relation, through the use of any conventional form of mounting means (not shown) suitable for use for such a purpose, within the air compartment 72. The air nozzle 74 is operatively connected to the air supply means 28, the latter having been described herein previously, through the air ducts 32, which as best understood with reference to FIG. 1 of the drawing are connected in fluid flow relation to the fan 30 on the one hand and on the other hand, as seen schematically at 76 in FIG. 1 of the drawing, to the air nozzle 74 through separate valves and controls (not shown) whereby the air supply means 28 supplies air to the air nozzle 74 and therethrough into the burner region 16 of the fossil fuel-fired furnace 10 in the same manner as that which has been described herein previously in connection with the discussion hereinbefore of the air nozzles 26, 50 and 62.

Also, in accord with the illustrated embodiment of the firing system 12, a fourth fuel compartment, denoted generally by the reference numeral 78 in FIG. 2 of the drawing, is provided in the windbox 22 such as to be located substantially in Juxtaposed relation to the air compartment 72. A fourth fuel nozzle, denoted by the reference numeral 80 in FIG. 2 of the drawing, is supported in mounted relation, through the use of any conventional form of mounting means (not shown) suitable for use for such a purpose, within the fuel compartment 78. The fuel nozzle 80 is operatively connected to the fuel supply means 40, the latter having been described previously herein, through the fuel ducts 44, which as best understood with reference to FIG. 1 of the drawing are connected in fluid flow relation on the one hand to the pulverizer 42 wherein the fossil fuel that is to be burned in the fossil fuel-fired furnace 10 undergoes pulverization in a manner well-known to those skilled in the art, and on the other hand as seen schematically at 82 in FIG. 1 of the drawing to the fuel nozzle 80 through separate valves and controls (not shown) whereby the fuel supply means 40 supplies fuel to the fuel nozzle 80 and therethrough into the burner region 16 of the fossil fuel-fired furnace 10 in the same manner as that which has been described herein previously in connection with the discussion hereinbefore of the fuel nozzles 38,56 and 68. It has been mentioned previously herein that as can best be seen with reference to FIG. 1 of the drawing the pulverizer 42 is operatively connected to the fan 30 such that air is also supplied from the fan 30 to the pulverizer 42 whereby the fuel supplied from the pulverizer 42 to the fuel compartment 78 is transported through the fuel ducts 44 in an air stream in a manner well-known to those skilled in the art.

A description will now be had herein of the nature of the construction of the advanced overfire air system 14 of the present invention, and of the manner in which the advanced overfire air system 14 in accordance with the present invention forms part of a firing system, such as the firing system 12. For purposes of this description, reference will be had in particular to FIGS. 1 and 2 of the drawing. Thus, as best understood with reference to FIGS. 1 and 2, the advanced overfire air system 14 in accord with the best mode embodiment of the invention includes a pair of close coupled overfire air compartments, denoted generally by the reference numerals 84 and 86, respectively, in FIG. 2 of the drawing. The close coupled overfire air compartments 84 and 86, in accord with the best mode embodiment of the invention, are provided in the windbox 22 of the firing system 12 within the upper portion of the windbox 22 such as to be located substantially in juxtaposed relation to the fuel compartment 78, the latter having been the subject of discussion hereinbefore. A pair of close coupled overfire air nozzles, denoted by the reference numerals 88 and 90, respectively, in FIG. 2 of the drawing, are supported in mounted relation, through the use of any conventional form of mounting means (not shown) suitable for use for such a purpose, within the pair of close coupled overfire air compartments such that the close coupled overfire air nozzle 88 is mounted in the close coupled overfire air compartment 84 and the close coupled overfire air nozzle 90 is mounted in the close coupled overfire air compartment 86. The close coupled overfire air nozzles 88 and 90 are each operatively connected to the air supply means 28, the latter having been described herein previously, through the air ducts 32, which as best understood with reference to FIG. 1 of the drawing are connected in fluid flow relation to the fan 30 on the one hand and on the other hand as seen schematically at 92 in FIG. 1 of the drawing to each of the close coupled overfire air nozzles 88 and 90 through separate valves and controls (not shown) whereby the air supply means 28 supplies air to each of the close coupled overfire air nozzles 88 and 90 and therethrough into the burner region 16 of the fossil fuel-fired furnace 10.

Continuing with the description of the advanced overfire air system 14, in accordance with the best mode embodiment of the invention the advanced overfire air system 14 further includes a plurality of separated overfire air compartments, which are suitably supported, through the use of any conventional form of support means (not shown) suitable for use for such a purpose, within the burner region 16 of the furnace 10 so as to be spaced from the close coupled overfire air compartments 84 and 86, and so as to be substantially aligned with the longitudinal axis of the windbox 22. The aforementioned plurality of separated overfire air compartments, in accordance with the preferred embodiment of the invention, comprises in number three such compartments, which are denoted generally in FIG. 2 of the drawing by the reference numerals 94,96 and 98, respectively. A plurality of separated overfire air nozzles, denoted by the reference numerals 100,102 and 104, respectively, in FIG. 2 of the drawing, are supported in mounted relation, through the use of any conventional form of mounting means (not shown) suitable for use for such a purpose, within the plurality of separated overfire air compartments 94,96 and 98 such that the separated overfire air nozzle 100 is mounted for both vertical (tilting) and horizontal (yaw) movement in the separated overfire air compartment 94, the separated overfire air nozzle 102 is mounted for both vertical (tilting) and horizontal (yaw) movement in the separated overfire air compartment 96, and the separated overfire air nozzle 104 is mounted for both vertical (tilting) and horizontal (yaw) movement in the separated overfire air compartment 98. The plurality of separated overfire air nozzles 100,102 and 104 are each operatively connected to the air supply means 28, the latter having been described herein previously, through the air ducts 32, which as best understood with reference to FIG. 1 of the drawing are connected in fluid flow relation to the fan 30 on the one hand and on the other hand as seen schematically at 106 in FIG. 1 of the drawing to each of the separated overfire air nozzles 100,102 and 104 through separate valves and controls (not shown) whereby the air supply means 28 supplies air to each of the separated overfire air nozzles 100,102 and 104 and therethrough into the burner region 16 of the fossil fuel-fired furnace 10.

A brief description will now be set forth herein of the mode of operation of the advanced overfire air system 14 constructed in accordance with the present invention and of the firing system 12 with which the advanced overfire air system 14 is designed to be employed for the purpose of effectuating a reduction in the $NO_x$ emissions from a furnace, such as the fossil fuel-fired furnace 10, in which there is installed both the firing system 12 and the advanced overfire air system 14 that is cooperatively associated therewith. Insofar as concerns the mode of operation of the firing system 12, constructed in accordance with the illustration thereof in FIGS. 1 and 2 of the drawing, air and fossil fuel is introduced into the burner region 16 of the fossil fuel-fi·ed furnace 10 through alternate elevations of air compartments and fuel compartments which are suitably provided in the windbox 22 for this purpose. Namely, in accord with the illustrated embodiment of the firing system 12 air is introduced into the burner region 16 of the fossil fuel-fired furnace 10 through the air compartments 24,48,60 and 72, and fossil fuel is introduced into the burner region 16 of the fossil fuel-fired furnace 10 through the fossil fuel compartments 36,54,66 and 78. In a manner well-known to those skilled in this art there is initiated in the burner region 16 of the fossil fuel-fired furnace 10 combustion of the fossil fuel that is introduced thereinto through the fossil fuel compartments 36,54,66 and 78 and of the air that is introduced thereinto through the air compartments 24,48,60 and 72. The hot gases that are produced from this combustion of the fossil fuel and air in the burner region 16 of the fossil fuel-fired furnace 10 in known fashion rise upwardly in the fossil fuel-fired furnace 10. During this upwardly movement thereof in the fossil fuel-fired furnace 10, the hot gases give up heat in a manner well-known to those skilled in this art to the fluid flowing through the tubes (not shown) that in conventional fashion line all four of the walls of the fossil fuel-fired furnace 10. Then, these hot gases exit the fossil fuel-fired furnace 10 through the horizontal pass 18 of the fossil fuel-fired furnace 10, which in turn leads to the rear gas pass 20 of the fossil fuel-fired furnace 10. The horizontal pass 18 and the rear gas pass 20 commonly each contain other heat exchanger surface (not shown) for generating and super heating steam, in-a manner well-known to those skilled in this art. Thereafter, this steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine (not shown), such that electricity is thus produced from the generator (not shown).

Insofar as concerns the mode of operation of the advanced overfire air system 14, the objective sought to be achieved through the use thereof is that of inhibiting the rate of $NO_x$ formation by both atmospheric nitrogen fixation (thermal $NO_x$) and fuel nitrogen (fuel $NO_x$). This is accomplished by reducing the total oxygen that is available in the primary flame zone. To this end, in accord with the mode of operation of the advanced overfire air system 14, overfire air is introduced through one or two closely grouped compartments at a single fixed elevation of the burner region 16 of the fossil fuel-fired furnace 10 at the top of the windbox 22, and through one or more additional compartments located at a higher elevation. The closely grouped compartments, commonly referred to in the industry as close coupled overfire air compartments, are seen at 84 and 86 in FIG. 2 of the drawing, and the compartments located at the higher elevation, commonly referred to in the industry as separated overfire air compartments, are seen at 94,96 and 98 in FIG. 2 of the drawing.

Figure 3:
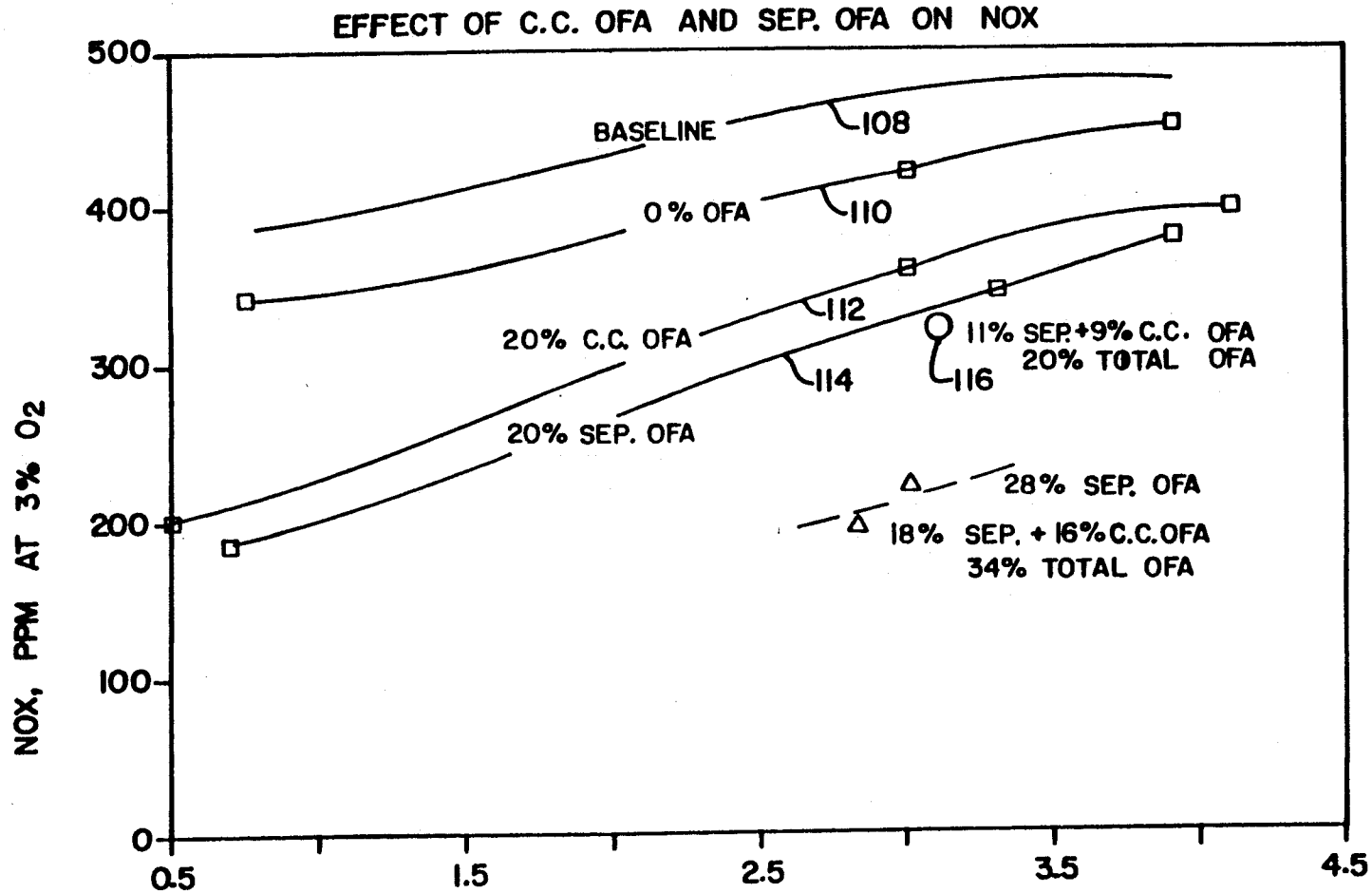
FIG. 3 is a graphical depiction of the effect on $NO_x$ when using an advanced overfire air system constructed in accordance with the present invention wherein there is a predetermined apportionment of the overfire air between close coupled overfire air and separated overfire air.

One of the characteristics which the advanced overfire air system 14 embodies in accordance with the present invention is that the overfire air is introduced into the burner region 16 of the fossil fuel-fired furnace 10 partly through the close coupled overfire air compartments 84 and 86 and partly through the separated overfire air compartments 94,96 and 98 such that there exists a predetermined most favorable distribution of the overfire air between close coupled overfire air and separated overfire air. The advantages that accrue from the utilization of this most favorable distribution of overfire air are best understood with reference to FIG. 3 of the drawing. As noted previously herein, FIG. 3 is a graphical depiction of the effect on $NO_x$ when using an advanced overfire air system constructed in accordance with the present invention wherein there is a predetermined apportionment of the overfire air between close coupled overfire air and separated overfire air. The line denoted by the reference numeral 108 in FIG. 3 represents a baseline plot of the $NO_x$ ppm levels from a furnace, such as the fossil fuel-fired furnace 10, when operating with a firing system, such as the firing system 12. On the other hand, the line denoted by the reference numeral 110 in FIG. 3 represents a plot of the $NO_x$ ppm levels from a furnace, such as the fossil fuel-fired furnace 10, when operating with a firing system, such as the firing system 12, and with 0% overfire air. Continuing, the line denoted therein by the reference numeral 112 represents a plot of the $NO_x$ ppm levels from a furnace, such as the fuel-fired furnace 10, when operating with 20% overfire air and wherein all 20% of the overfire air is introduced into the furnace as close coupled overfire. Whereas, the line denoted in FIG. 3 by the reference numeral 114 represents a plot of the $NO_x$ ppm levels from a furnace, such as the fossil fuel-fired furnace 10, when operating with 20% overfire air and wherein all 20% of the overfire air is introduced into the furnace as separated overfire air.

With further reference to FIG. 3, the point denoted therein by the reference numeral 116 is a plot of the $NO_x$ ppm level from a furnace, such as the fossil fuel-fired furnace 10, when operating with a firing system 12 with which an advanced overfire air system 14 constructed in accordance with the present invention is cooperatively associated and with 20% overfire air, and wherein of the 20% overfire air in accordance with a most favorable distribution thereof 9% of this overfire air is introduced as close coupled overfire air and 11% of the overfire air is introduced as separated overfire air. Thus, from the preceding and from a reference to FIG. 3 the following should now be readily apparent: 1) that the use of overfire air results in a reduction in the $NO_x$ ppm levels as compared to when 0% overfire air is employed, 2) that the use of overfire air wherein all of the overfire air is introduced as separated overfire air results in a greater reduction in the $NO_x$ ppm levels as compared to when the same amount of overfire air is employed but all of this overfire air is introduced as close coupled overfire air, and 3) that an even greater reduction in $NO_x$ ppm level is realized when the same amount of overfire air is employed but this overfire air is introduced into the furnace in accordance with a most favorable distribution thereof as between close coupled overfire air and separated overfire air, e.g., as illustrated in FIG. 3 wherein with 20% overfire air being introduced, the most favorable distribution thereof is 9% close coupled overfire air and 11% separated overfire air. This most favorable distribution of overfire air between close coupled overfire air and separated overfire air has been found to vary as a function of coal type. For example, in the case of bituminous coal the tests that were run therewith show that the most favorable distribution of the overfire air was $\frac{1}{3}$ close coupled overfire air and $\frac{2}{3}$ separated overfire air.

Figure 4:
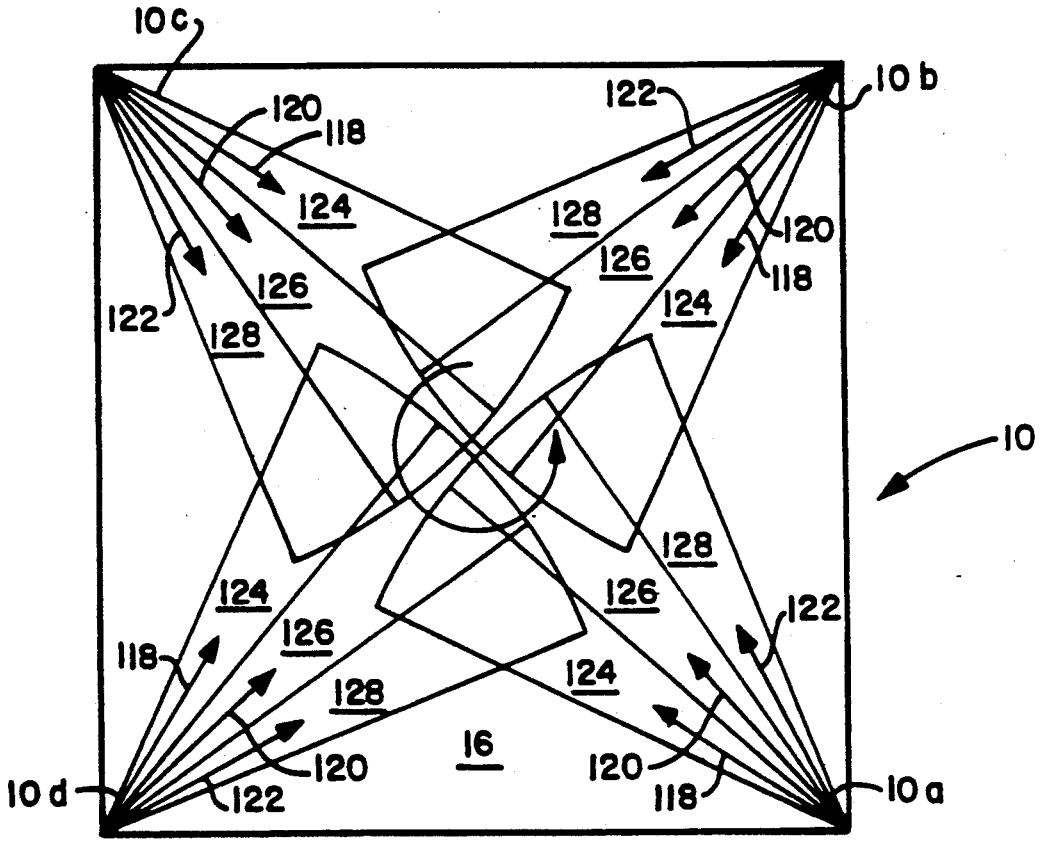
FIG. 4 is a plan view of the horizontal "spray" or "fan" distribution pattern for the overfire air which is-employed in an advanced overfire air system constructed in accordance with the present invention.

A second characteristic which the advanced overfire air system 14 embodies in accordance with the present invention is that the separated overfire air is injected into the burner region 16 of the fossil fuel-fired furnace 10 from each of the four corners thereof through a plurality, e.g., two, three or more compartments with each compartment introducing a portion of the total separated overfire air flow at different firing angles, which angles are established by moving the separated overfire air nozzles 94,96 and 98 vertically (tilting) and/or horizontally (yawing), such as to achieve a horizontal "spray" or "fan" distribution of separated overfire air over the furnace plan area. The specific nature of this horizontal "spray" or "fan" distribution of separated overfire air over the plan area of the burner region 16 of the fossil fuel-fired furnace 10 is depicted in FIG. 4 of the drawing. To this end, as best seen with reference to FIG. 4 the separated overfire air in accord with the present invention is injected into the burner region 16 of the fossil fuel-fired furnace 10 from each corner thereof, the latter being denoted in FIG. 4 by the reference numerals 10*a*,10*b*,10*c* and 10*d*, respectively. In accord with the best mode embodiment of the invention, this injection of the separated overfire air is accomplished through the three separated overfire air compartments 94,96 and 98, which have been described hereinbefore and which are illustrated in FIG. 2 of the drawing.

Although not shown in FIG. 2, it is to be understood that the four corners 10*a*,10*b*,10*c* and 10*d* of the fossil fuel-fired furnace 10 are each provided with separated overfire air compartments 94,96 and 98. Moreover, the separated overfire air that is injected into the burner region 16 of the fossil fuel-fired furnace 10 from each of the four corners 10*a*,10*b*,10*c* and 10*d* thereof through the separated overfire air compartments 94,96 and 98 located thereat is injected at a different firing angle, the latter being denoted in FIG. 4 by means of the reference numerals 118,120 and 122, respectively, and wherein for ease of reference the same numerals are utilized in connection with each of the four corners 10*a*,10*b*,10*c* and 10*d* of the fossil fuel-fired furnace 10. Further, as best understood with reference to FIG. 4 of the drawing, the injection into the burner region 16 of the fossil fuel-fired furnace 10 at the different firing angles denoted by the reference numerals 118,120 and 122 in FIG. 4 has the effect of producing a horizontal "spray" or "fan" distribution of the separated overfire air over the furnace plan area. Namely, as depicted in FIG. 4, the separated overfire air that is injected into the burner region 16 of the fossil fuel-fired furnace 10 at each of the different firing angles 118,120 and 122 follows the path denoted by the reference numerals 124,126 and 128, respectively. Collectively the paths 124,126 and 128 create a distribution pattern which as best seen with reference to FIG. 4 is in the form of a horizontal "spray" or "fan" distribution pattern. Also, to be noted from FIG. 4 is the fact that the distribution pattern for the separated overfire air injected from each of the corners 10*a*,10*b*,10*c* and 10*d* of the fossil fuel-fired furnace 10 substantially overlap one another at the center of the burner region 16 of the fossil fuel-fired furnace 10.

Figure 5:
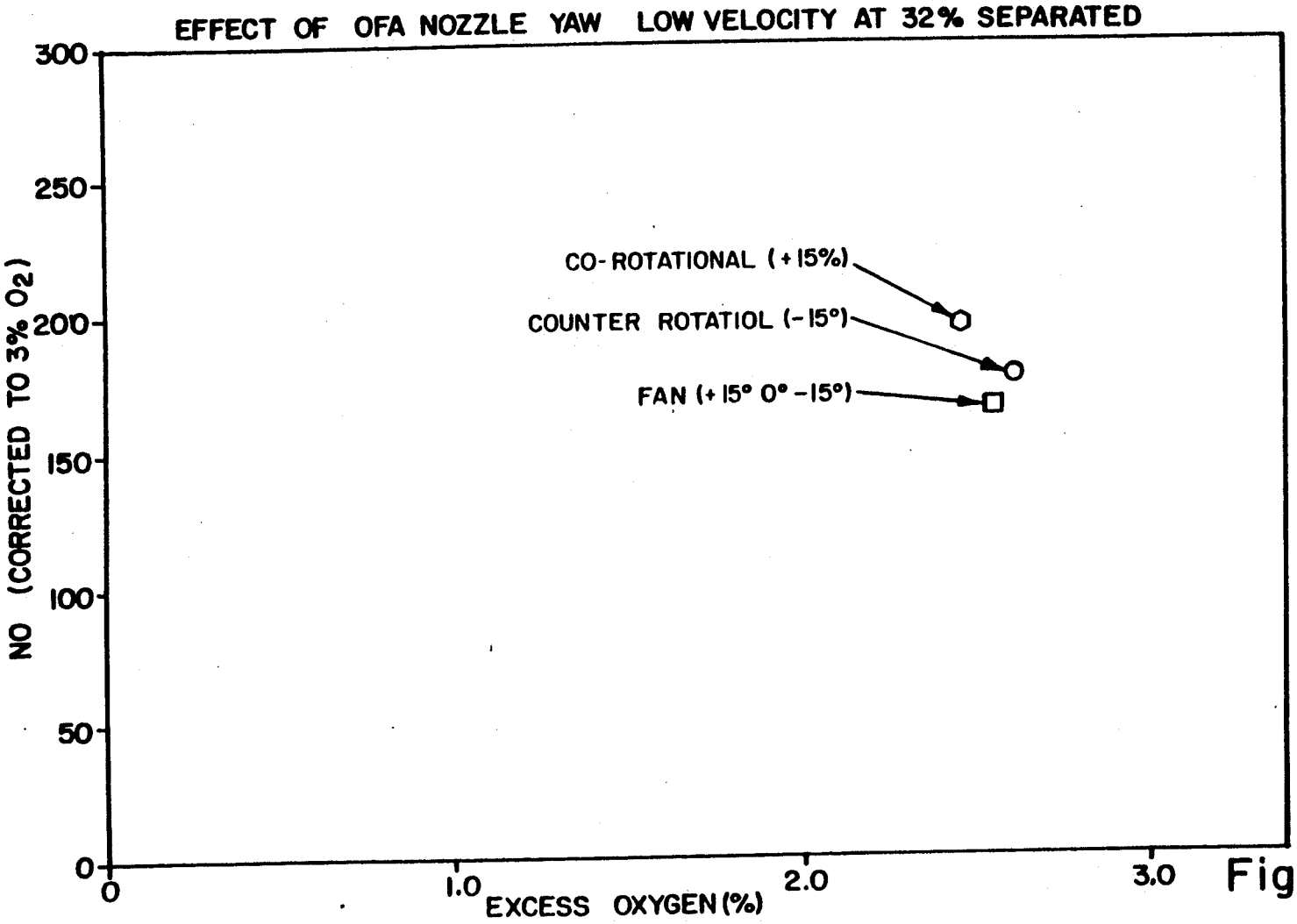
FIG. 5 is a graphical depiction of the effect on $NO_x$ of using an advanced overfire air system constructed in accordance with the present invention wherein the overfire air is distributed in accordance with the horizontal "spray" or "fan" distribution pattern illustrated in FIG. 4.

The advantages that accrue from the utilization of different firing angles for purposes of injecting into the burner region 16 of the fossil fuel-fired furnace 10 the separated overfire air from the separated overfire air compartments 94,96 and 98 are best understood with reference to FIG. 5 of the drawing. As noted previously herein, FIG. 5 is a graphical depiction of the effect on $NO_x$ of using an advanced overfire air system constructed in accordance with the present invention wherein the overfire air is distributed in accordance with the horizontal "spray" or "fan" distribution pattern illustrated in FIG. 4. Referring to FIG. 5, the point denoted therein by the reference numeral 130 is a plot of the $NO_x$ ppm level from a furnace, such as the fossil fuel-fired furnace 10, when operating with a firing system, such as the firing system 12, and wherein all of the separated overfire air that is injected through the separated overfire air compartments is injected into the burner region 16 of the fossil fuel-fired furnace 10 at the same firing angle, i.e., at an angle of $+15°$ such that the separated overfire air is injected so as to be co-rotational with the fuel and air that is being injected into the burner region 16 of the fossil fuel-fired furnace 10 through the fuel compartments 38,54,66 and 78 and the air compartments 24,48,60 and 72, respectively. The point denoted in FIG. 5 by the reference numeral 132 is a plot of the $NO_x$ ppm level from a furnace, such as the fossil fuel-fired furnace 10, when operating with a firing system, such as the firing system 12, and wherein all of the separated overfire air that is injected through the separated overfire air compartment is injected into the burner region 16 of the fossil fuel-fired furnace 10 at the same firing angle, i.e, at an angle of $-15°$ such that the separated overfire air is injected so as to be counter rotational with the fuel and air that is being injected into the burner region 16 of the fossil fuel-fired furnace 10 through the fuel compartments 38,54,66 and 78 and the air compartments 24,48,60 and 72, respectively. With further reference to FIG. 5, the point denoted therein by the reference numeral 134 is a plot of the $NO_x$ ppm level from a furnace, such as the fossil fuel-fired furnace 10, when operating with a firing system 12 with which an advanced overfire air system 14 constructed in accordance with the present invention is cooperatively associated and wherein all of the separated overfire air is injected through each of the separated overfire air compartments 94,96 and 98 at a different firing angle such that the horizontal "spray" or "fan" distribution of separated overfire air that is depicted in FIG. 4 of the drawing is achieved over the furnace plan area. In accord with the best mode embodiment of the invention, the firing angles that are employed for this purpose for the separated overfire air compartments 94,96 and 98 are +15°, 0° and −15°. Thus, from the preceding and from a reference to FIG. 5 the following should now be readily apparent: 1) that injecting all of the separated overfire air through the separated overfire air compartments at the same firing angle of −15° such that the separated overfire air is injected so as to be counter rotational with the fuel and air that is being injected into the burner region 16 of the fossil fuel-fired furnace 10 through the fuel compartments 38,54,66 and 78 and the air compartments 24,48,60 and 72, respectively, results in a greater reduction in the $NO_x$ ppm level as compared to when all of the separated overfire air is injected through the separated overfire air compartments at the same angle of +15° such that all of the separated overfire air is injected so as to be co-rotational with the fuel and air that is being injected into the burner region 16 of the fossil fuel-fired furnace 10 through the fuel compartments 38,54,66 and 78 and the air compartments 24,48,60 and 72, respectively, and 2) that injecting all of the separated overfire air through the separated overfire air compartments 94,96 and 98 at different firing angles of +15°, 0° and −15° such that the horizontal "spray" or "fan" distribution of separated overfire air that is depicted in FIG. 4 of the drawing is achieved over the furnace plan area results in a greater reduction in the $NO_x$ ppm level as compared to when all of the separated overfire air is injected through the separated overfire air compartments at the same firing angle of −15° such that the separated overfire air is injected so as to be counter rotational with the fuel and air that is being injected into the burner region 16 of the fossil fuel-fired furnace 10 through the fuel compartments 38,44,66 and 78 and the air compartments 24,48,60 and 72, respectively.

Figure 6:
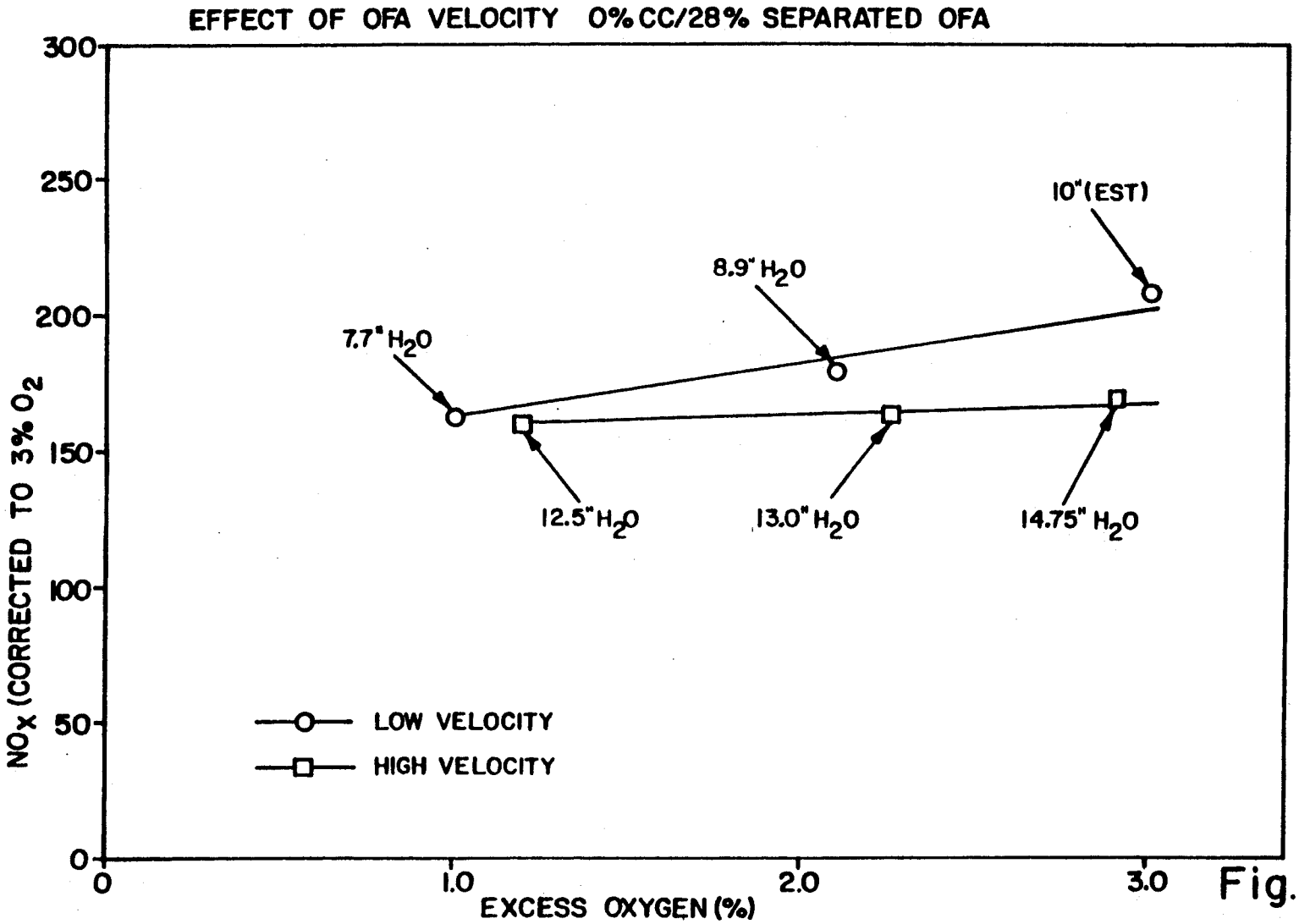
FIG. 6 is a graphical depiction of the effect on $NO_x$ of using an advanced overfire air system constructed in accordance with the present invention wherein the overfire air is injected into the furnace at high velocities.

A third characteristic which the advanced overfire air system 14 embodies in accordance with the present invention is that the separated overfire air is injected into the burner region 16 of the fossil fuel-fired furnace 10 at velocities significantly higher than those utilized heretofore in prior art firing systems, e.g., 200 to 300 ft./sec. versus 100 to 150 ft./sec. The advantages that accrue from the injection of the separated overfire air at such increased velocities are best understood with reference to FIG. 6 of the drawing. As noted previously herein, FIG. 6 is a graphical depiction of the effect on $NO_x$ of using an advanced overfire air system constructed in accordance with the present invention wherein the overfire air is injected into the furnace at high velocities. The line denoted by the reference numeral 136 in FIG. 6 represents a plot of the $NO_x$ ppm levels from a furnace, such as the fossil fuel-fired furnace 10, when operating with a firing system, such as the firing system 12 and wherein the overfire air is injected at low velocities, i.e., at the velocities commonly utilized heretofore in prior art firing systems. On the other hand, the line denoted by the reference numeral 138 in FIG. 6 represents a plot of the $NO_x$ ppm levels from a furnace, such as the fossil fuel-fired furnace 10, when operating with a firing system 12 with which an advanced overfire air system 14 constructed in accordance with the present invention is cooperatively associated and wherein the separated overfire air injected into the burner region 16 of the fossil fuel-fired furnace 10 through the separated overfire air compartments 94,96 and 98 is injected at velocities significantly higher than those utilized heretofore in prior art firing systems, e.g., 200 to 300 ft./sec. versus 100 to 150 ft./sec. Thus, from the preceding and from a reference to FIG. 6 it should now be readily apparent that injecting all of the separated overfire air through the separated overfire air compartments 94,96 and 98 into the burner region 16 of the fossil fuel-fired furnace 10 at velocities significantly higher than those utilized heretofore in prior art firing systems results in a greater reduction in the $NO_x$ ppm levels as compared to when all of the overfire air is injected into the burner region 16 of the fossil fuel-fired furnace 10 at low velocities, i.e., at the velocities commonly utilized heretofore in prior art firing systems.

Thus, in accordance with the present invention there is provided a new and improved advanced overfire air system for $NO_x$ control which is designed for use in a firing system of the type that is employed in fossil fuel-fired furnaces. As well, there is provided in accord with the present invention an advanced overfire air system for $NO_x$ control that is designed for use in a firing system of the type that is employed in tangentially fired, fossil fuel furnaces. Moreover, in accord with the present invention there is provided an advanced overfire air system for $NO_x$ control for use in a firing system of the type employed in tangentially fired, fossil fuel furnaces such that through the use thereof $NO_x$ emissions are capable of being reduced to levels that are at least equivalent to, if not better than, that which is currently being contemplated as the standard for the United States in the legislation being proposed. Also, there is provided in accord with the present invention an advanced overfire air system for $NO_x$ control that is designed for use in a firing system of the type employed in tangentially fired, fossil fuel furnaces characterized in that the advanced overfire air system involves the use of multi-elevations of overfire air compartments consisting of close coupled overfire air compartments and separated overfire air compartments. Further, in accordance with the present invention there is provided an advanced overfire air system for $NO_x$ control that is designed for use .in a firing system of the type employed in tangentially fired, fossil fuel furnaces and which is characterized in that there is a predetermined most favorable distribution of overfire air between the close coupled overfire air compartments and the separated overfire air compartments. Besides, there is provided in accord with the present invention an advanced overfire air system for $NO_x$ control that is designed for use in a firing system of the type employed in tangentially fired, fossil fuel furnaces and which is characterized in that the advanced overfire air system involves the use of a multi-angle injection pattern. In addition, in accordance with the present invention there is provided an advanced overfire air system for $NO_x$ control that is designed for use in a firing system of the type employed in tangentially fired, fossil fuel furnaces and which is characterized in that in accordance with the multi-angle injection pattern thereof a portion of the total overfire air flow is introduced at different angles such as to achieve a horizontal "spray" or "fan" distribution of overfire air over the plan area of the furnace. Furthermore, there is provided in accord with the present invention an advanced overfire air system for $NO_x$ control that is designed for use in a firing system of the type employed in tangentially fired, fossil fuel furnaces and which is characterized in that the advanced overfire air system involves the injection of overfire air into the furnace at velocities significantly higher than those utilized heretofore in prior art firing systems. Additionally, in accordance with the present invention there is provided an advanced overfire air system for $NO_x$ control that is designed for use in a firing system of the type employed in tangentially fired, fossil fuel furnaces such that through the use thereof no additions, catalysts or added premium fuel costs are needed for the operation thereof. Penultimately, there is provided in accord with the present invention an advanced overfire air system for $NO_x$ control that is designed for use in a firing system of the type employed in tangentially fired, fossil fuel furnaces and which is characterized in that the advanced overfire air system is totally compatible with other emission reduction-type systems such as limestone injection systems, reburn systems and selective catalytic reduction (SCR) systems that one might seek to employ in order to accomplish additional emission reduction. Finally, in accordance with the present invention there is provided an advanced overfire air system for $NO_x$ control that is designed for use in a firing system of the type employed in tangentially fired, fossil fuel furnaces and which is characterized in that the advanced overfire air system is equally well suited for use either in new applications or in retrofit applications.

While several embodiments of my invention have been shown, it will be appreciated that modifications thereof, some of which have been alluded to hereinabove, may still be readily made thereto by those skilled in the art. I, therefore, intend by the appended claims to cover the modifications alluded to herein as well as all the other modifications which fall within the true spirit and scope of my invention.

What is claimed is:

1. A method of operating for $NO_x$ control a fossil fuel-fired furnace having a plurality of walls embodying therewithin a burner region comprising the steps of:

a. providing in the burner region of the furnace a windbox embodying a plurality of elevations;

b. introducing fossil fuel in a first direction into the burner region of the furnace through the windbox at a first elevation thereof;

c. introducing combustion supporting secondary air in the first direction into the burner region of the furnace through the windbox at a second elevation thereof;

d. introducing fossil fuel in the first direction into the burner region of the furnace through the windbox at a third elevation thereof;

e. providing a plurality of overfire air compartments in the burner region of the furnace above and in spaced relation to the windbox;

f. introducing overfire air into the burner region of the furnace in a second direction opposite to the first direction through one of the plurality of overfire air compartments;

introducing overfire air into the burner region of the furnace in a direction other than the second direction through one of the plurality of overfire air compartments.

2. The method of operating for $NO_x$ control a fossil fuel-fired furnace as set forth in claim 1 further comprising the step of introducing the overfire air into the burner region of the furnace through the plurality of overfire air compartments at velocities in the range of 200 ft./sec. to 300 ft./sec.

3. The method of operating for $NO_x$ control a fossil fuel-fired furnace as set forth in claim 1 further comprising the step of introducing overfire air in the first direction into the burner region of the furnace through the windbox at a fourth elevation thereof.

4. The method of operating for $NO_x$ control a fossil fuel-fired furnace as set forth in claim 3 wherein more overfire air is introduced into the burner region of the furnace through the plurality of overfire air compartments than is introduced into the burner region of the furnace through the windbox at the fourth elevation thereof.

* * * * *